United States Patent [19]

Hengel et al.

[11] 4,335,202

[45] Jun. 15, 1982

[54] TETRAAZAUNDECANE AND COMPLEXES AS SENSITIZERS FOR SILVER HALIDE EMULSION

[75] Inventors: Rolf Hengel, Heilbronn, Fed. Rep. of Germany; David F. Eaton, Wilmington, Del.

[73] Assignee: E. I. Du Pont de Nemours and Company, Wilmington, Del.

[21] Appl. No.: 292,261

[22] Filed: Aug. 12, 1981

[51] Int. Cl.[3] ..... G03L 1/28

[52] U.S. Cl. ..... 430/604; 430/599; 430/603; 430/607; 430/605

[58] Field of Search ..... 430/599, 604, 600, 605, 430/603, 607

[56] References Cited

U.S. PATENT DOCUMENTS

| | | | |
|---|---|---|---|
| 2,743,182 | 4/1956 | Lowe et al. | 430/599 |
| 3,930,867 | 1/1976 | Bigelow | 430/600 |

*Primary Examiner*—Won H. Louie, Jr.

[57] ABSTRACT

Tetraazaundecane and certain derivatives thereof serve as a chemical sensitizer for negative silver halide emulsions.

10 Claims, No Drawings

TETRAAZAUNDECANE AND COMPLEXES AS SENSITIZERS FOR SILVER HALIDE EMULSION

BACKGROUND OF THE INVENTION

1. Field of the Invention

The present invention deals with photographic silver halide elements prepared by chemical sensitization, and particularly with new compounds and metal complexes for this purpose.

2. Description of the Prior Art

A wide variety of chemical compounds and complexes, known as chemical sensitizers, react chemically with photographic silver halide grains. While these grains exhibit natural sensitivity to light, chemical sensitization allows the sensitivity to be considerably enhanced. If the purpose is to produce direct positive emulsions the grains are reacted until they are fogged.

Known prior art sensitizing and fogging agents include organic and inorganic sulfur compounds, gold and other heavy metal complexes, amines, and boranes. Bigelow in U.S. Pat. No. 3,930,867 discloses macrocyclic polyamines, salts and metal chelates as sensitizers for silver halide emulsions. Structures for several prior art polyamine sensitizers, some of which are disclosed in Bigelow, are as follows:

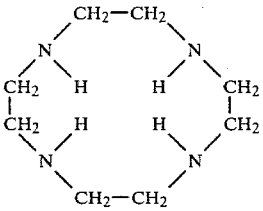

cyclene or 1,4,7,10-tetraazacyclododecane

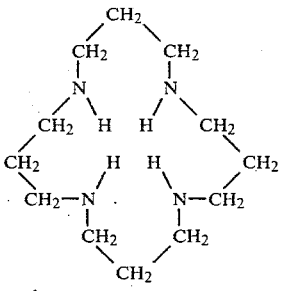

cyclam or 1,4,8,11-tetraazacyclotetradecane

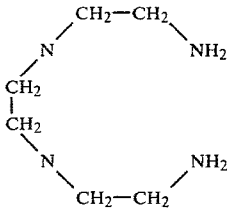

tetraazadecane

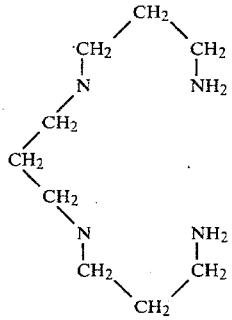

tetraazatridecane

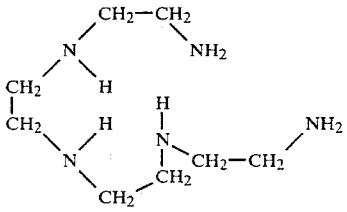

tetraethylenepentamine

The present invention provides a class of polyamine sensitizers for silver halide emulsions which are somewhat analogous in structure to prior art polyamine sensitizers, but have increased emulsion speed, which can be translated into reduced silver coating weight.

SUMMARY OF THE INVENTION

The invention resides in the discovery that tetraazaundecane, its acid salts, and metal complexes thereof, are effective as sensitizers for negative-working silver halide emulsion grains. The invention also includes photographic film containing the sensitized silver halide emulsion on a film support. The general formulas for the compound and complexes are:

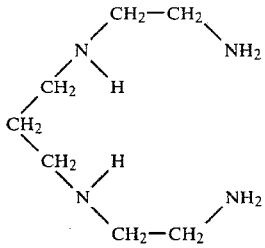

and

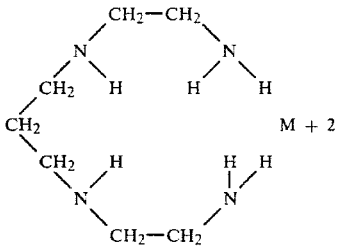

where $M^{+2}$ is a divalent metal such as copper, nickel, zinc, and calcium, which forms a stable complex.

The activity of tetraazaundecane is believed to be due to its ability to produce silver atoms which serve as sensitivity specks according to the following disproportionation reaction.

$$\underset{\text{I}}{2\,Ag^{+1}.\,TAU} \longrightarrow Ag^{\circ} + \underset{\text{II}}{Ag^{+2}.\,TAU}$$

where TAU stands for the tetraazaundecane molecule. It is believed that the presence of complex I in the emulsion acts as a sensitizing agent.

DETAILED DESCRIPTION OF THE INVENTION

The compounds of the present invention are effective when added prior to digestion or as afteradditions, in the same manner as other prior art sensitizers for silver halide emulsions. Since it functions independently of other sensitizers or fogging agents, tetraazaundecane (TAU) serves as a primary reactant as opposed to some other linear polyamines which can only increase the sensitivity of an already sensitized emulsion.

Particularly useful compounds are the white crystalline acid salts: $TAU.(HNO_3)_4$ and $TAU.(HCl)_4$; the blue crystalline complex $TAU.Cu(NO_3)_2$; the violet crystalline complex $TAU.NiCl_2.2H_2O$, and the white crystalline complex $TAU.ZnCl_2$. While tetraazaundecane by itself is more reactive than its acid salt or metal complex, the latter are more convenient to use in the sensitization reaction because they can be used in larger amounts and are therefore easier to control.

A wide variety of negative emulsions can be prepared with TAU compounds. These emulsions can contain the usual additives known in the art and can be coated on a variety of supports such as cellulose acetate, polyethylene terephthalate, metal foil, paper, glass plates, etc. A sensitizing amount of TAU, its acid salts, or its divalent metal complexes, is in the range of 0.005 to 50 mg per 1.5 mole of silver halide in the emulsion. Within this range, extremely small quantities of TAU enhance sensitometric properties of emulsions which have already been chemically digested.

The invention is illustrated by the following Examples.

EXAMPLE 1

A high speed silver iodobromide emulsion containing 1–2% iodide was gold-sulfur sensitized (0.048 millimols organic sulfur sensitizer and 0.2 millimols of gold, per mole AgBr) and then stabilized with 4-hydroxy-6-methyl-1,3,3a,7-tetraazaindene and mercuric chloride. Afteradditions of tetraazaundecane and other prior art polyamines were made to portions of the emulsion prior to coating on a polyethylene terephthalate support. The resulting film samples were given a 10−2 EGG exposure and tray developed for 2 minutes at room temperature in XMD (medical X-ray Developer available from E. I. du Pont de Nemours and Company, Wilmington, Delaware). Table 1 contains a summary of the results.

TABLE 1

| Amine Added | Mg/1.5 mole AgX | B & F[1] | Relative Speed |
|---|---|---|---|
| None | — | .13 | 100 |
| Cyclene | .2 | .13 | 107 |
| Cyclam | .2 | .16 | 107 |
| Tetraazadecane | .2 | .25 | 114 |
| Tetraazatridecane | .2 | .32 | 127 |
| Tetraethylenepentamine | .2 | .32 | 136 |
| Tetraazaundecane | .2 | 2.32 | (top density fog)[2] |
| Tetrazaundecane | .02 | .21 | 141 |

[1]Base = Fog
[2]Turns completely black in the developer.

This illustrates the increased activity of tetraazaundecane in comparison with prior art polyamines. Considering that when tetraazaundecane was added at the same level as the other polyamines, which serve as controls, the fog was increased to the top density level, these results indicate that tetraazaundecane is ten times as effective in sensitization as polyamines of the prior art. Hence it will produce direct positive emulsions unless the amounts employed are reduced to levels comparable to those of the prior art polyamines.

EXAMPLE 2

The hydrochloric acid salt and the zinc and nickel complexes of tetraazaundecane were evaluated by adding them to portions of the sensitized and stabilized emulsion of Example 1. Table 2 contains sensitometric results in terms of speed, gradient and fog.

TABLE 2

| Addition | Mg/1.5 Mole AgX | Rel. Speed | Gradient | Fog |
|---|---|---|---|---|
| None | — | 100 | 1.6 | .10 |
| TAU . $(HCl)_4$ | 2 | 115 | 1.4 | .10 |

TABLE 2-continued

| Addition | Mg/1.5 Mole AgX | Rel. Speed | Gradient | Fog |
|---|---|---|---|---|
| TAU . $(HCl)_4$ | 4 | 132 | 1.6 | .10 |
| TAU . $NiCl_2 . 2H_2O$ | 3 | 123 | 1.6 | .10 |
| TAU . $NiCl_2 . 2H_2O$ | 6 | 132 | 1.6 | .09 |
| TAU . $ZnCl_2$ | 3 | 141 | 1.7 | .11 |

These results, compared to those of Example 1, show that (1) it is necessary to employ higher quantities of the tetraazaundecane derivatives in order to obtain a speed increase comparable to that obtained from tetraazaundecane per se; (2) a substantial increase in speed is obtained without adverse effect on gradient and fog.

EXAMPLE 3

The emulsion of Example 1 was digested using only half the sulfur sensitizer previously used, but with gold and stabilizers the same. Table 3 illustrates results obtained when tetraazaundecane was added at digestion in combination with the reduced sulfur sensitization.

TABLE 3

| Tetraazaundecane Mg/1.5 mole AgX | B & F | Rel. Speed |
|---|---|---|
| 0 | .17 | 100 |
| .002 | .17 | 100 |
| .004 | .17 | 100 |
| .008 | .18 | 114 |
| .02 | .19 | 141 |

These results illustrate that very low quantities of tetraazaundecane are ineffective inasmuch as no difference is observed relative to the control. At higher levels tetraazaundecane provides significant speed increase with minimal effect on fog.

EXAMPLE 4

Example 3 was repeated except that in place of tetraazaundecane the nitric acid salt and copper complex of tetraazaundecane were used. Table 4 gives results.

TABLE 4

| Addition | Mg/1.5 mole AgX | B & F | Relative Speed |
|---|---|---|---|
| 0 | — | .17 | 100 |
| TAU . $(HNO_3)_4$ | .02 | .18 | 107 |
| TAU . $(HNO_3)_4$ | .16 | .24 | 111 |
| TAU . $(HNO_3)_4$ | .24 | .29 | 123 |
| TAU . $Cu(NO_3)_2$ | .04 | .17 | 104 |
| TAU . $Cu(NO_3)_2$ | .08 | .19 | 114 |
| TAU . $Cu(NO_3)_2$ | .16 | .22 | 119 |
| TAU . $Cu(NO_3)_2$ | .24 | .23 | 123 |

These results show that the nitric acid salt and copper complex are similarly effective in increasing speed, but that higher quantities are required relative to Example 3.

EXAMPLE 5

Portions of the emulsion of Example 1 were digested without gold and using one half the sulfur sensitizer of Example 1, with comparative additions of tetraazaundecane, its nitric acid salt, and a copper complex, prior to coating. Comparative results are given in Table 5.

TABLE 5

| Addition | Mg/1.5 mole AgX | B & F | Relative Speed |
|---|---|---|---|
| 0 | — | .16 | 100 |
| TAU . $Cu(NO_3)_2$ | .2 | .16 | 119 |
| TAU . $(HNO_3)_4$ | .2 | .16 | 119 |
| TAU | .04 | .16 | 127 |
| TAU | .2 | .21 | 162 |

These results show that the compounds of the present invention are effective in emulsions without gold sensitization. As was the case in gold-sensitized emulsions, tetraazaundecane is more active than its acid salt or metal complex.

EXAMPLE 6

A medium speed iodobromide emulsion containing 1% iodide was gold-sulfur sensitized as in Example 1 except that 0.024 millimols organic sulfur sensitizer was added per mole AgBr, then stabilized with 4-hydroxy-6-methyl-1,3,3a,7-tetraazaindene and mercuric chloride. Afteradditions of the hydrochloric acid salt and calcium complex of tetraazaundecane were made to portions of the emulsion prior to coating on a support. Film samples were given a $10^{-2}$ EGG exposure and tray developed for three minutes in XMD. Table 6 gives results.

TABLE 6

| Addition | Mg/1.5 Mole AgX | Rel. Speed | Gradient | Fog |
|---|---|---|---|---|
| 0 | — | 100 | 1.2 | .04 |
| TAU . $(HCl)_4$ | 2 | 132 | 1.5 | .05 |
| TAU . $CaCl_2$ . $H_2O$ | 2 | 132 | 1.5 | .04 |

TABLE 6-continued

| Addition | Mg/1.5 Mole AgX | Rel. Speed | Gradient | Fog |
|---|---|---|---|---|
| TAU . $CaCl_2$ . $H_2O$ | 4 | 123 | 1.3 | .04 |

These results show improvement in both gradient and speed without significant effect on fog.

We claim:

1. A negative-working gelatino-silver halide emulsion containing a sensitizing amount of a linear polyamine selected from the group consisting of tetraazaundecane (TAU), an acid salt thereof, and a divalent metal complex thereof.

2. The emulsion of claim 1 wherein the linear polyamine is employed in an amount of 0.005 to 50 mg per 1.5 mole of silver halide in the emulsion.

3. The emulsion of claim 1 wherein the metal component of the divalent metal complex is selected from the group consisting of copper, nickel, zinc, and calcium.

4. The emulsion of claim 1 wherein the acid salt is TAU.$(HNO_3)_4$.

5. The emulsion of claim 1 wherein the acid salt is TAU$(HCl)_4$.

6. The emulsion of claim 3 wherein the metal complex is TAU.$NiCl_2.2H_2O$.

7. The emulsion of claim 3 wherein the metal complex is TAU.$ZnCl_2$.

8. The emulsion of claim 3 wherein the metal complex is TAU.$Cu(NO_3)_2$.

9. Photographic film containing the sensitized gelatino-silver halide emulsion of claim 1 on a film support.

10. The photographic film of claim 9 wherein the emulsion is a gelatino-AgIBr emulsion containing 1–2% iodide, said emulsion being gold-sulfur sensitized, stabilized, and further sensitized by the addition thereto of an acid salt or divalent metal complex of tetraazaundecane.

* * * * *